US005366348A

United States Patent [19]

Skelton

[11] Patent Number: 5,366,348

[45] Date of Patent: Nov. 22, 1994

[54] METHOD AND APPARATUS FOR SELECTIVELY VARYING THE FLOW RATE OF SERVICE LIQUID THROUGH A TWO STAGE LIQUID RING VACUUM PUMP

[75] Inventor: Kevin J. Skelton, Oakfield, N.Y.

[73] Assignee: Graham Manufacturing Co., Inc., Batavia, N.Y.

[21] Appl. No.: 126,908

[22] Filed: Sep. 24, 1993

[51] Int. Cl.[5] ..... F04C 19/00; F04B 3/00

[52] U.S. Cl. ..... 417/68; 417/53; 417/244

[58] Field of Search ..... 417/53, 68, 69, 244, 417/438

[56] References Cited

U.S. PATENT DOCUMENTS

| | | | |
|---|---|---|---|
| Re. 29,747 | 8/1978 | Roe et al. | 417/68 |
| 1,904,321 | 4/1933 | Nash | 417/68 |
| 2,672,276 | 3/1954 | Adams | 417/68 |
| 3,108,738 | 10/1963 | Lühmann | 417/68 |
| 4,685,865 | 8/1987 | Auschrat | 417/68 |
| 5,246,348 | 9/1993 | Wallace et al. | 417/68 |

FOREIGN PATENT DOCUMENTS

| | | | |
|---|---|---|---|
| 2248731 | 1/1973 | France | 417/68 |
| 269506 | 1/1914 | Germany | 417/68 |
| 67729 | 2/1928 | Germany | 417/68 |
| 2317420 | 3/1975 | Germany | 417/68 |
| 484836 | 9/1953 | Italy | 417/68 |
| 103650 | 2/1942 | Sweden | 417/68 |
| 1728531 | 4/1992 | U.S.S.R. | 417/68 |

*Primary Examiner*—Richard A. Bertsch
*Assistant Examiner*—Roland G. McAndrews, Jr.
*Attorney, Agent, or Firm*—Cumpston & Shaw

[57] ABSTRACT

A two stage liquid ring vacuum pump having a selectively variable flow rate of service liquid through a first stage and a second stage. The flow rate through the second stage is reduced by venting service liquid from the second stage prior to normal passage through a discharge port. The vented service liquid is introduced in the first stage to enhance the pumping capacity of the first stage.

13 Claims, 5 Drawing Sheets

METHOD AND APPARATUS FOR SELECTIVELY VARYING THE FLOW RATE OF SERVICE LIQUID THROUGH A TWO STAGE LIQUID RING VACUUM PUMP

BACKGROUND OF THE INVENTION

The present invention relates to liquid ring vacuum pumps, and more particularly, to varying the flow rate and the volume of a service liquid in the stages of a two stage liquid ring vacuum pump.

Liquid ring vacuum pumps are well known and widely used in industrial applications for a smooth non-pulsating gas or vapor removal. The working parts of a liquid ring vacuum pump include a multi-bladed impeller eccentrically mounted in a cylindrical casing which is partially filled with a service liquid. As the impeller rotates, the liquid is thrown by centrifugal force to form a liquid ring which is concentric with the periphery of the casing. Due to the eccentric positioning of the impeller relative to the casing and the liquid ring, the spaces or cells between adjacent impeller blades are cyclically filled and emptied with the service liquid as the impeller rotates. During rotation of the impeller any air or gas trapped in the cell is compressed and discharged from the casing through an outlet port leaving the cell available to receive air or gas which is presented to the suction port of the casing.

Two stage liquid ring vacuum pumps are used in applications requiring relatively high vacuums. The two stage liquid ring vacuum pump can produce and efficiently maintain suction pressures from 150 to 25 mm Hg absolute. A two stage liquid ring vacuum pump has two impellers working in series on a volumetric ratio which can be as high as 3:1, first stage to second stage. The impellers are affixed to a common shaft and are rotated at the same rotational speed. The two stages can accommodate a greater capacity at lower absolute suction pressures than a single stage of compression. However, two stage liquid ring vacuum pumps exhibit the inherent problem of lower capacity at high absolute suction pressures.

To maximize efficiency, the desired operating parameters and required system component sizes must be matched for a given two stage liquid ring vacuum pump. However, the relatively large range of operating parameters forces trade offs in matching component capabilities. That is, some individual components may not be maximized in view of trade offs with other components at certain operating conditions.

Two stage liquid ring vacuum pumps are well suited for efficiently and reliably maintaining the low absolute pressure at the holding point. However, the two stage liquid ring vacuum pumps require a substantial period of time to completely evacuate a vessel. In fact, evacuation with a two stage liquid ring vacuum pump is usually slower than other available methods. For example, evacuation ejectors or single stage vacuum pumps are often more effective than two stage liquid ring vacuum pumps during the evacuation stage.

Therefore, the need exists for maximizing the capacity of two stage liquid ring vacuum pumps. A need also exists for improving the evacuation capacities of the liquid ring vacuum pump, without sacrificing capability elsewhere. In addition, the need exists for optimizing horsepower requirements throughout the range of operating parameters. The need also exists for improving the evacuation capacity of a two stage liquid ring vacuum pump without requiring excessive recirculating and cooling facilities for the service liquid.

SUMMARY OF THE INVENTION

The method and apparatus of the present invention improves the capacity of two stage liquid ring vacuum pumps having a first stage and a second stage which are intermediate of a suction port and a discharge port. The invention includes selectively varying the flow rate or volume of the service liquid in at least one of the first and the second stages of a two stage liquid ring vacuum pump. The terms "service liquid," "seal liquid," or "pumping liquid" are used to define the liquid that forms a liquid ring in a liquid ring vacuum pump upon rotation of the impellers. The present disclosure employs the term service liquid, however, it is understood that any of the alternative terms may be used without effecting the scope of the present invention. Service liquids are well known in the art and are often substantially composed of water.

The present invention accommodates the theory that the gas flow capacity of a two stage pump is a function of the displacement capability of the individual stages. The volumetric capacity of each stage is different and may be as high as a 3:1 ratio. The optimal volume or flow rate of service liquid through each stage is at least partially determined by the volume of the stage. Therefore, where the stages have different volumetric capacities, the flow rate which maximizes the capacity of each stage is different. To optimize the capacity of a two stage liquid ring vacuum pump having different capacity stages, the volume, or flow rate of service liquid in the stages must be different.

For example, when the quantity of compressed gas from the first stage is larger than the volumetric capacity of the second stage, the interstage pressure is higher than the discharge pressure and the pump is not operating in an efficient manner. The second stage acts as a restriction and thereby determines the handling capacity of the two stage pump at high absolute suction pressures. This restriction generally occurs when the overall pump compression ratio is less than 3:1. As the load quantity to the second stage is reduced and approaches the volumetric capacity of the second stage, the two stages balance and pump efficiency increases.

The present invention optimizes the flow rate or volume of service liquid for a stage throughout a range of operating parameters of the pump. Specifically, the respective flow rates of the service liquid through the first and second stage are different to optimize the capacity of each stage. The performance characteristics of each stage may be selectively controlled by varying the relative flow rates of service liquid through the stage in response to, or anticipation of certain loads or demands on the pump.

A specific embodiment of the present invention is employed during the evacuation process, wherein a portion of the service liquid in the second stage is withdrawn through a bypass port located upstream of the discharge port. In a preferred embodiment, the withdrawn service liquid is introduced into the first stage. By removing a portion of the service liquid from the second stage and introducing it back into the first stage, the pump can be operated at optimum capacity for evacuation. It is believed the venting of service liquid from the second stage and the increased flow rate through the first stage effectively reduces compression across the second stage and enhances the capacity of the first stage. The enhanced flow of service liquid through the first stage improves the efficiency of the first stage so that the compressed gas flow rate produced by the first stage is sufficiently compressed so that the second stage does not substantially further compress the gas and the second stage functions as a liquid pump rather than a gas compressing pump. During evacuation, added compression in the second stage is not required as the first stage is able to sufficiently compress the gas. However, the net amount of service liquid flowing out of the pump through the discharge port is equal to the original volume, but an increased capacity of the pump is recognized as a result of the redirection of the service liquid.

The apparatus of the preferred embodiment includes a bypass port in the second stage intermediate of the first stage and the discharge port. A fluid bypass line extends from the bypass port to the first stage. The bypass port intersects the second stage at the point of highest fluid compression in the second stage. The relatively high pressure fluid from the second stage passes through the bypass port and the bypass line to be introduced into the first stage to increase the flow rate of service liquid through the first stage.

DETAILED DESCRIPTION OF THE PREFERRED EMBODIMENTS

Figure 1:
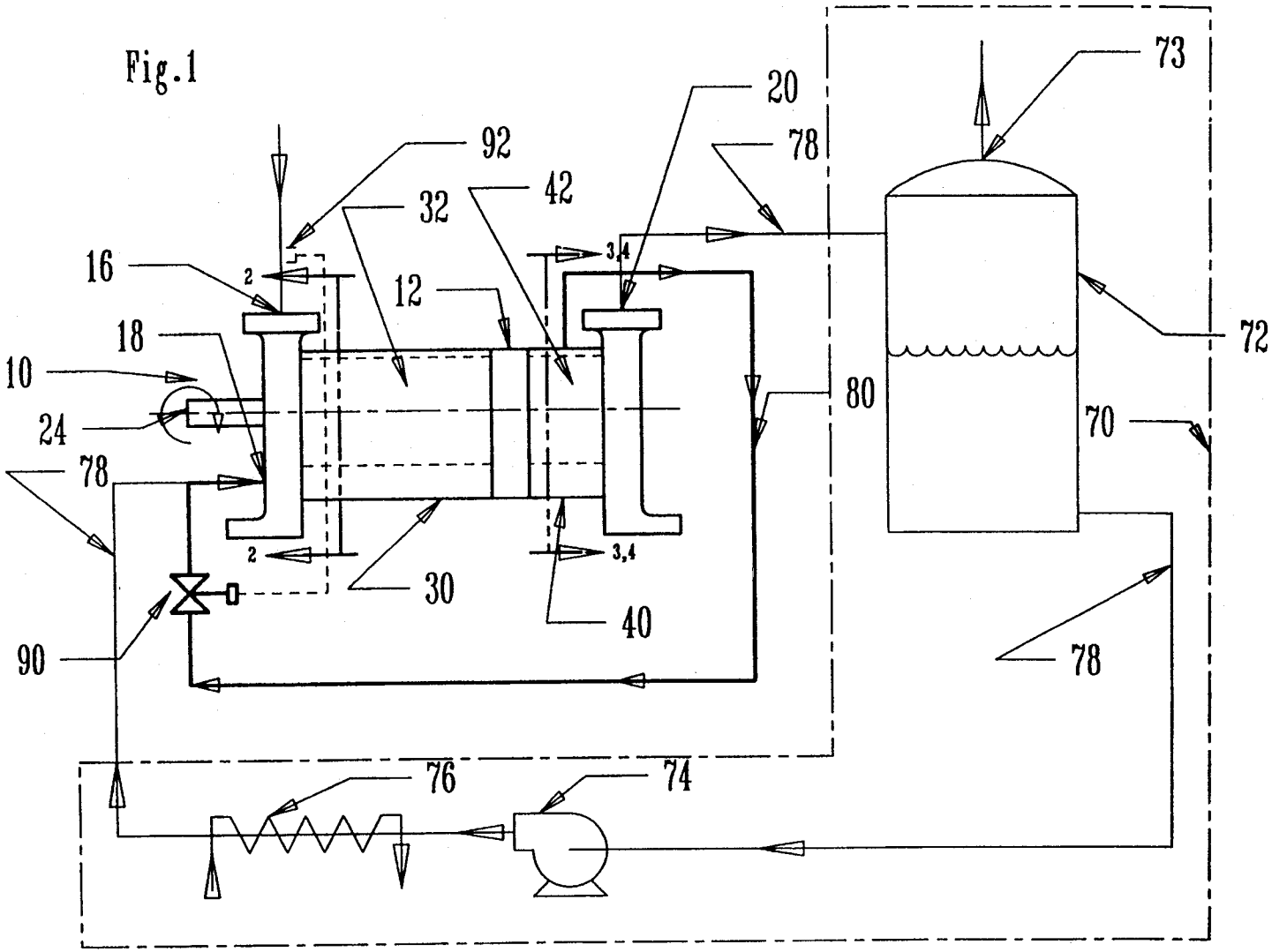
FIG. 1 is a schematic view of a two stage liquid ring vacuum pump system having the present invention incorporated therein.

Referring to FIG. 1, the present invention is employed with a two stage liquid ring vacuum pump 10, which is well known in the art. The vacuum pump 10 includes a cylindrical casing 12 having a first stage 30 and a second stage 40, with a suction port 16 and a service liquid inlet 18 connected to the first stage, and a discharge port 20 connected to the second stage. The suction port 16 is fluidly connected to a vessel (not shown) to be evacuated and/or maintained at a reduced pressure. The first stage 30 houses a first stage impeller 32 and the second stage 40 houses a second stage impeller 42. The first and second stage impellers 32, 42 are connected to a drive shaft 24 to rotate with the shaft. A motor (not shown) is used to rotate the shaft 24, as is well known in the art. As shown in FIGS. 2–5, the first and second stage impellers 32, 42 include a hub 54 from which a plurality of blades 58 extend radially outward. Referring to FIGS. 2–5, the first stage impeller 32 includes 12 blades and the second stage impeller 42 includes 15 blades. However, the specific number of blades 58 per impeller may vary depending upon pump design and operating characteristics. The hub 54 includes a central aperture 55 sized to receive the drive shaft 24. A cell or cavity C is defined by adjacent blades 58, and the segment of the hub 54 between the blades.

Figure 2:
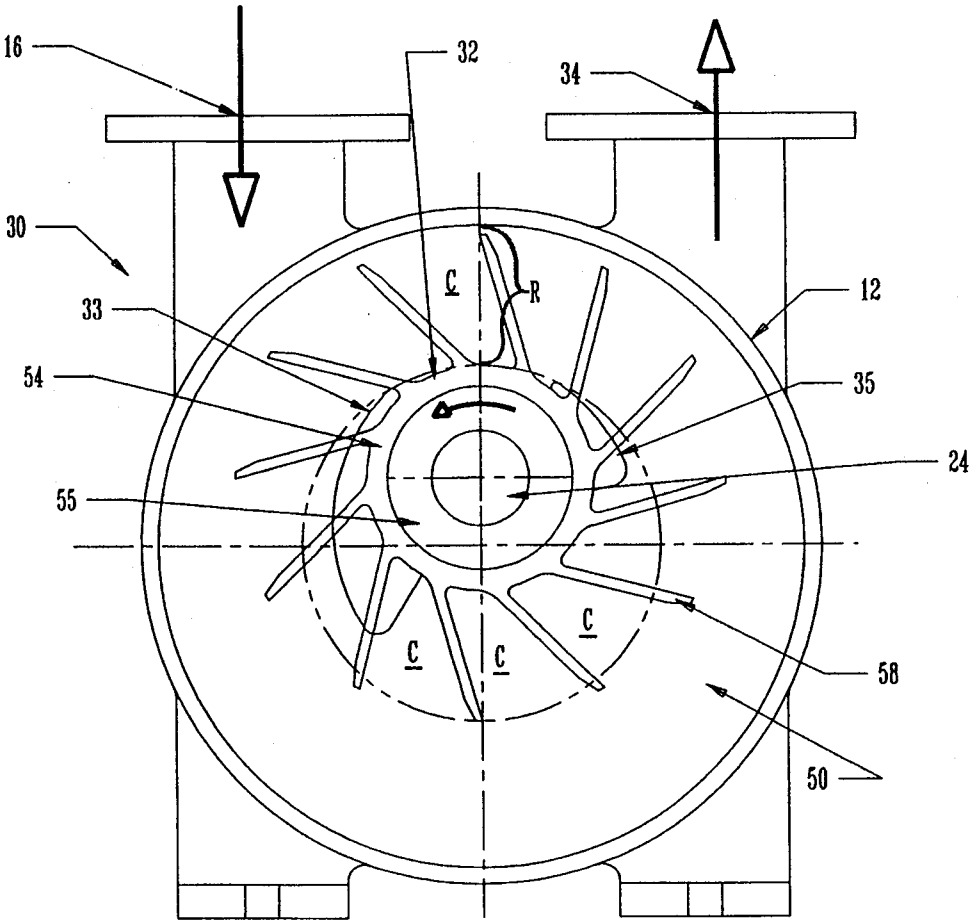
FIG. 2 is a cross sectional view taken along lines 2—2 of FIG. 1 showing the first stage of the liquid ring vacuum pump.

Referring to FIG. 2, the first stage 30 includes the suction port 16 and a transfer tube 34. The suction port 16 is fluidly connected to the first stage 30 by an inlet port 33. The transfer tube 34 is fluidly connected to the first stage 30 by an outlet port 35.

Figure 3:
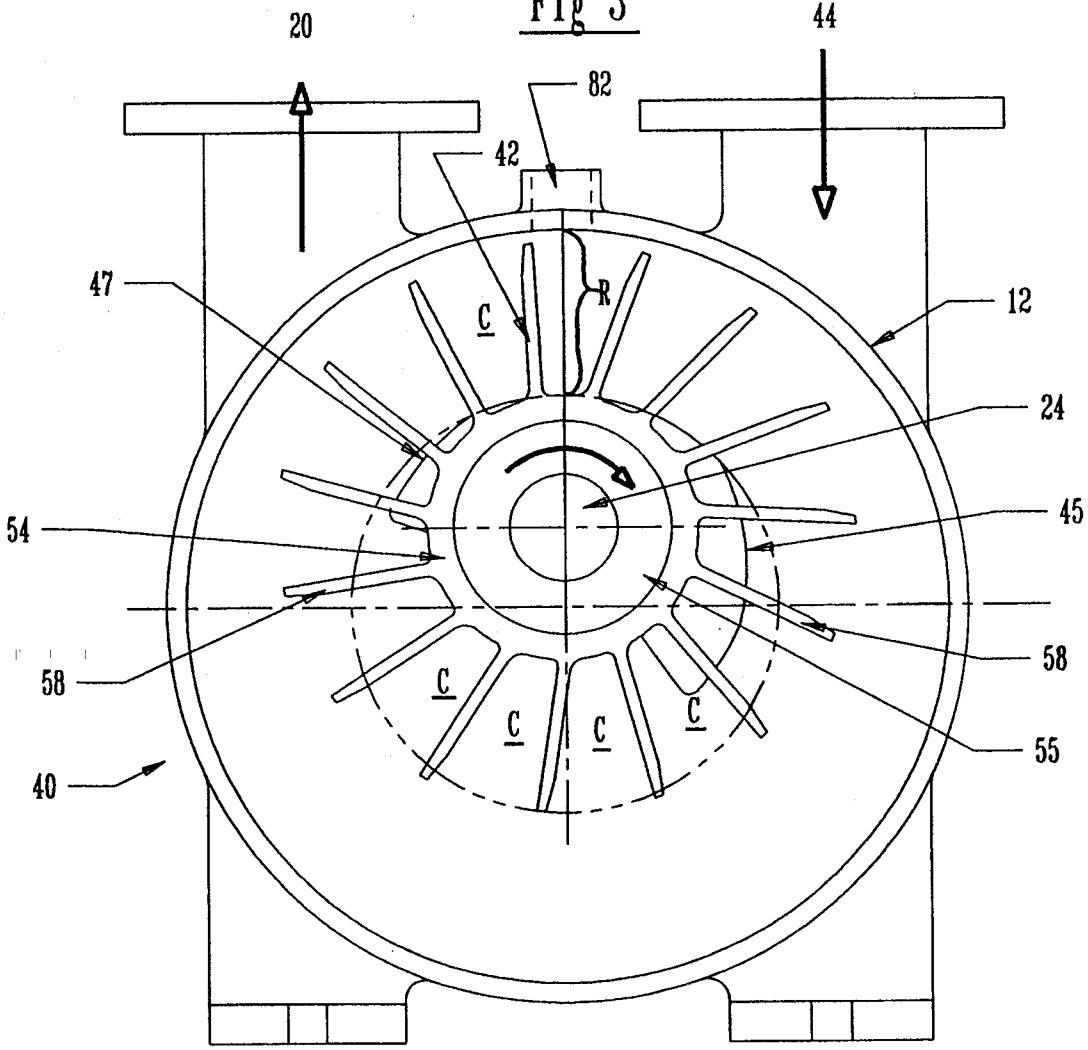
FIG. 3 is a cross sectional view taken along lines 3—3 of FIG. 1 showing the second stage in an operative condition prior to initiating the present invention.
Figure 4:
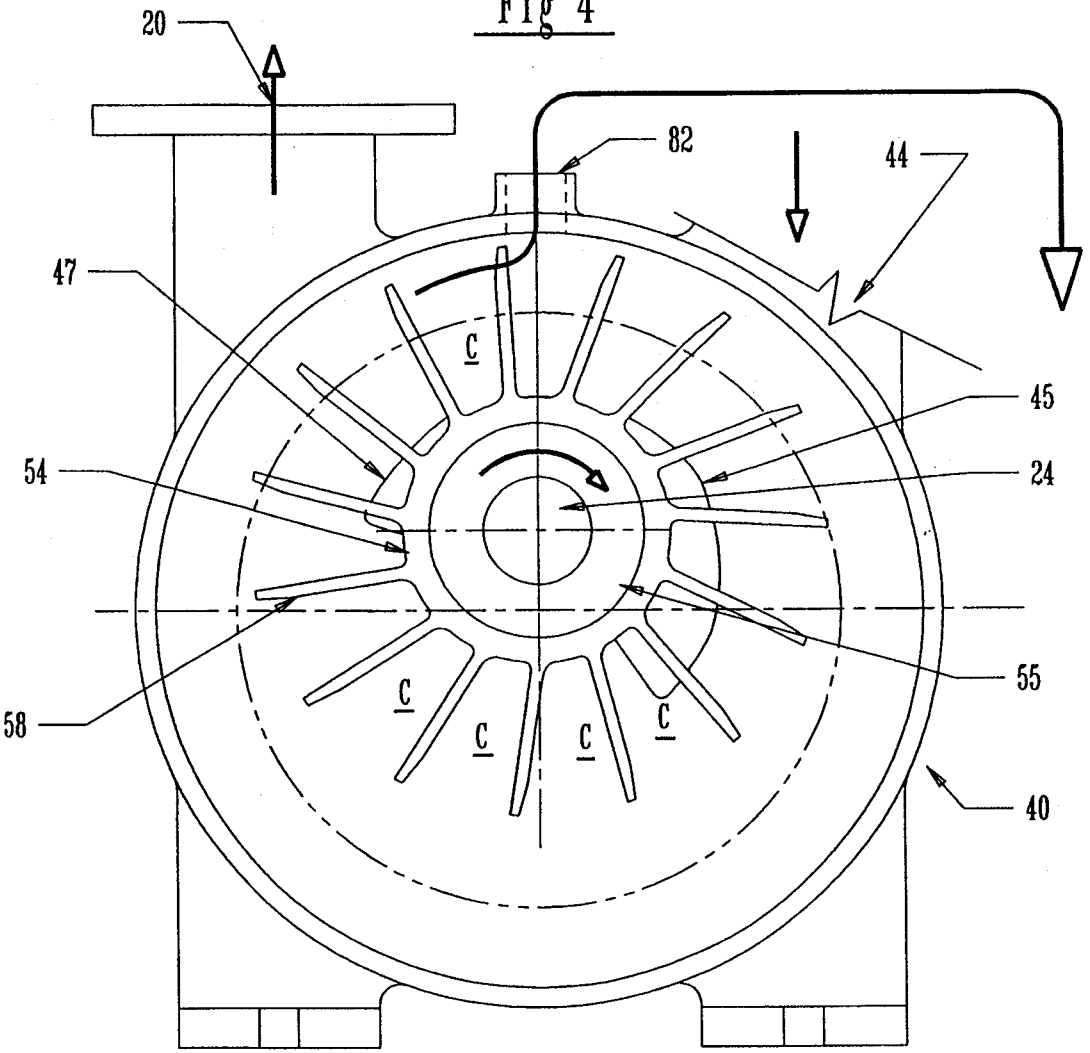
FIG. 4 is a cross sectional view taken along fines 4—4 of FIG. 1 showing the second stage in an operative position after initiation of the present invention.
Figure 5:
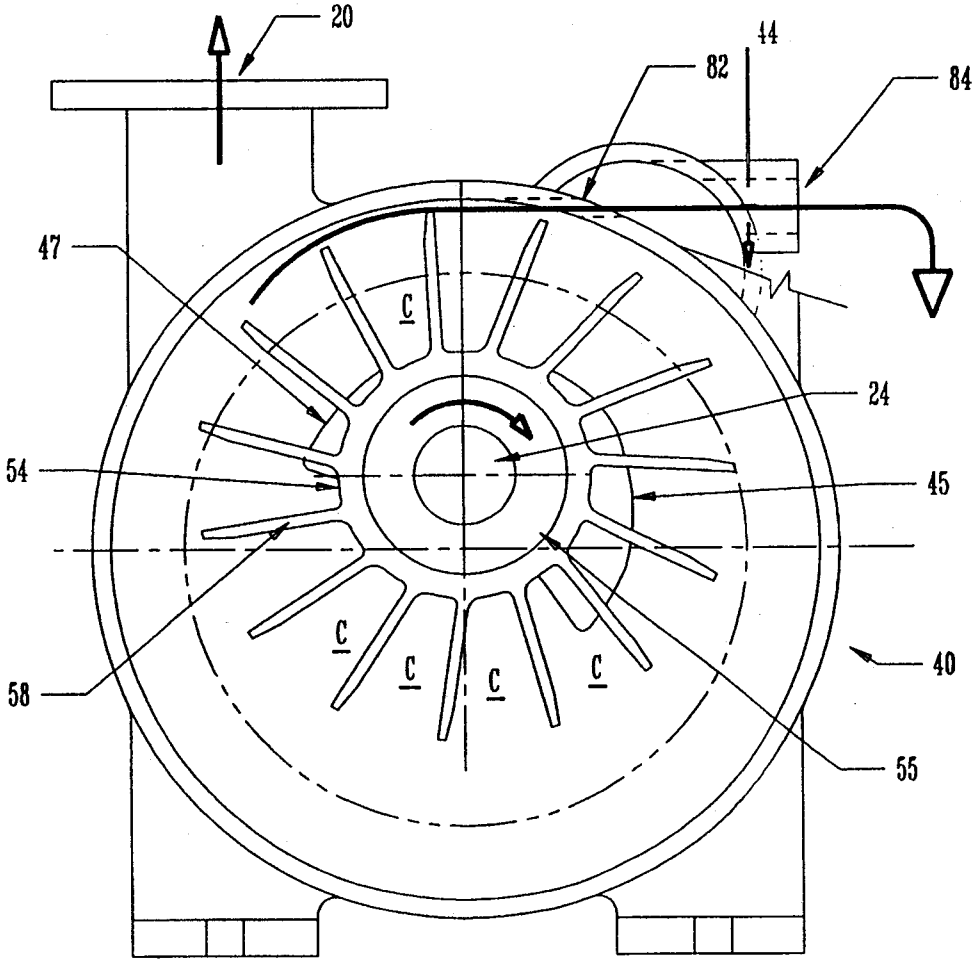
FIG. 5 is a cross sectional view of a second stage having an alternative embodiment of the second stage having a bypass manifold fluidly connected to a plurality of bypass ports.

As shown h FIGS. 3–5, the second stage 40 includes the discharge port 20 and a transfer tube 44. The transfer tube 44 is fluidly connected to an inlet port 45 in the second stage 40. A second stage outlet port 47 is fluidly connected to the discharge port 20. As known in two stage liquid ring vacuum pump designs, a portion of the gas compressed by the first stage 30 passes within the casing 12 to the second stage 40, and a portion of the gas flows from the outlet port 35 through the transfer tube 34 to the transfer tube 44 and into the second stage 40. Therefore, the vapor or gas flow path through the pump 10 begins at the suction port 16 and passes into the first stage 30. The service liquid enters the pump 10 at the service liquid inlet 18 and then passes into the first stage 30. The flow path then pass to the second stage 40 either within the casing 12 or via the transfer tubes 34 and 44. The flow paths then extend through the second stage 40 to exit the pump 10 through the discharge port 20.

During operation of the liquid ring vacuum pump 10, the service liquid is the compressant and any warmer incoming gas will approach the temperature of the service liquid before the compression starts. In addition to being the compressing medium, the service liquid absorbs the heat generated by compression and friction. To avoid overheating, and enhance efficiency, this heat must be removed from the service liquid. Therefore, the service liquid may flow through the liquid ring vacuum pump 10 in a once through manner or may be recirculated after cooling. For purposes of discussion, the present invention is described in terms of recirculating the service liquid. However, it is understood that the same principles can be applied to a once through system.

As shown in FIG. 1, the discharge port 20 is fluidly connected to a service liquid recirculation unit 70. The service liquid recirculation unit 70 includes a gas/liquid separator 72, a pump 74 and a heat exchanger 76 fluidly connected to each other and the liquid ring vacuum pump 10 by a recirculation line 78. Upon exiting the vacuum pump 10, the gas and any entrained fluid or service liquid pass into the gas/liquid separator 72. The gas/liquid separator 72 is well known in the art and separates the entrained liquids such as service liquid and condensables from the evacuated gas. The gas/liquid separator discharges or vents the evacuated gas through a vent 73.

The service liquid is recirculated by the pump 74 and passes through the heat exchanger 76 to cool the service liquid. The service liquid is then introduced into the first stage 30 at the service liquid inlet 18. As the two stage liquid ring vacuum pump 10 operates at a substantially steady state for most of its operation, the components of the service liquid recirculation unit 70 are sized to satisfy the design parameters for average service liquid requirements.

The present invention includes a bypass port 82 intermediate of the first stage 30 and the discharge port 20. The bypass port 82 is preferably located at the point of maximum compression of the liquid in the second stage 40. As shown in FIGS. 3–5, the point of maximum compression is at the top of the casing 12, where the cell C is most completely filled with service liquid. The bypass port 82 may include a series of ports extending along a width of the second stage 40. The number and size of the bypass ports 82 is determined by design considerations such as the size of the stages 30, 40 and the anticipated demands on the pump 10. Referring to FIG. 5, the multiple ports 82 are fluidly connected to a bypass manifold 84. The bypass manifold 84 is fluidly connected to a bypass line 80 extending from the second stage 40 to the first stage 30 of the liquid ring vacuum pump 10. Preferably, the bypass line 80 is fluidly connected to the first stage 30 with the recirculation line 78 at inlet 18 as shown in FIG. 1. Alternatively, the bypass line 80 may be connected to the recirculation line 78 upstream of the inlet 18.

In one embodiment of the system as shown in FIG. 4, the bypass port 82 intersects the second stage 40 perpendicular to the casing 12. That is, the bypass port 82, and the bypass line 80 are located along a radial line extending from the drive shaft 24. In a second embodiment as shown in FIG. 5, the bypass port 82 is the bypass manifold 84 and bypass line 80 tangentially intersect the second stage 40. The tangential intersection is oriented so that the bypass port 82 is perpendicular to the flow path of the service liquid and the service liquid tends to flow into the bypass manifold 84 and the bypass line 80. While the bypass manifold 84 is shown in FIG. 5 with the tangential bypass port 82, it is understood that the bypass manifold can be employed with the radial or perpendicular bypass port or ports 82.

The bypass line 80 includes a control valve 90 for regulating the flow of service liquid through the bypass line. The control valve 90 is connect to a control signal device 92 such as a pressure sensor exposed to the vessel to be evacuated, a service liquid temperature sensor, or a timer. Upon a predetermined pressure (vacuum) in the vessel, at a predetermined temperature of the service liquid, or after a predetermined length of time, the control signal device 92 generates a signal to at least partially close the control valve 90 and terminate transfer of the service liquid from the second stage 40 to the first stage 30 through the bypass line 80. Alternatively, the control signal device 92 may be used to keep the bypass line 80 open throughout the evacuation process and during steady state operation. In addition, the control signal device 92 may be employed to selectively regulate the flow rate of service liquid through the bypass line 80 intermediate of a fully open and a fully closed configuration in response to a variety of operating parameters such as pressure, time, or service liquid temperature.

Normal Operation

Upon initiation of rotation of the impellers 32, 42 each stage contains a volume of service liquid. As the first stage 30 has a greater volumetric capacity than the second stage 40, the absolute volume of service liquid in the first stage is greater than the volume of service liquid in the second stage. During normal, steady state operation (holding point), the pump 10 discharges a steady flow rate of service liquid through the discharge port 20. The discharged service liquid is recirculated by the recirculation unit 70 to provide a steady state flow rate of service liquid through the first stage 30 and the second stage 40. That is, both the first stage 30 and the second stage 40 experience an equal flow rate of service liquid. During operation, the volume of service liquid in each stage is sufficient so that the liquid ring extends from the casing to the hub 54 of the impeller at the point where the hub is nearest the casing 12, thereby giving the liquid ring an operating radial dimension R, as shown in FIGS. 2 and 3. The inner surface of the liquid ring is adjacent or contacts the hub 54 at the closest approach of the hub to the casing. A liquid ring of radial dimension R is necessary to cause each cell to become completely void of gas during each rotation of the impeller.

Operation of the Invention

The present invention establishes a different flow rate of service liquid in each of the two stages 30, 40. That is, by selectively withdrawing service liquid through the bypass port 82, the flow rate of service liquid through the first stage 30 is different than the flow rate through the second state 40. The different flow rate creates a volume of service liquid in each stage which is different than the normal operating volume of service liquid. While the service liquid flow rates through the stages is different, the flow rate exiting through the discharge port 20 remains substantially constant. That is, the flow rate of service liquid through the recirculation unit 70 is substantially independent of any flow of service liquid through the bypass line 80.

With respect to a preferred embodiment, in an initial state, the vessel to be evacuated may be at or near atmospheric pressure. Upon rotation of the impellers 32, 42, the liquid 50 is thrown against the casing 12 to form a liquid ring within the first and second stage 30, 40. A constant volume of service liquid exits the second stage 40 through the discharge port 20 and separated in the gas/liquid separator 72, recirculated past the heat exchanger 76 and introduced into the first stage 30 at the inlet 18. As shown in FIGS. 2 and 3, the liquid rings in the first and the second stage 30, 40 have a radial dimension of R such that the inner surface of each liquid ring is adjacent or contacts the hub at the closest approach of the hub 54 to the casing 12. The flow of service liquid through the first and the second stage 30, 40 is equal.

The vessel to be evacuated is then exposed to the suction port 16 of the two stage liquid ring vacuum pump 10. As the pump 10 begins the evacuation cycle, the bypass line 80 is opened permitting the flow of the service liquid to go from the second stage 40 to the first stage 30 without passing through the recirculation unit 70. The pressure of the service liquid in the second stage 40 is sufficient to force service liquid to go from the second stage through the bypass line 80 to the first stage 30. Preferably, the service liquid from the second stage 40 is introduced into the first stage 30 to combine with the flow rate of the standard recirculated supply. The portion of the service liquid flowing through the bypass line 80 exits the second stage 40 intermediate of the first stage 30 and the discharge port 20.

Upon opening of the bypass line 80, the flow rate of service liquid through the respective stages is changed, such that the effective flow rate through the first stage 30 is increased and the flow rate through the second stage 40 is decreased. While the net amount of service liquid exiting through the discharge port 20 remains the same, the change in flow rate in each stage alters the compression across each stage 30, 40, and the capacity of each stage. Upon opening the bypass line 80, the increased flow rate of service liquid through the first stage 30 substantially increases the efficiency of the first stage. Under the present understanding of the invention, it is believed the increased flow rate through the first stage 30 reduces the amount of residual gas entrained in the service liquid as each cell C passes through the point of greatest liquid pressure. In addition, the increased flow rate through the first stage 30 may enhance the sealing functions of the service liquid in the first stage 30. The result of the increased flow rate is to increase the efficiency of the first stage 30. That is, the first stage 30 sufficiently compresses the volume of gas at relative high inlet pressures so that the volume of the compressed gas presented to the second stage 40 passes through the second stage at substantially the same rate and pressure as produced by the first stage.

Correspondingly, the opening of the bypass line 80 allows service liquid from the second stage 40 to exit the stage prior to the discharge port 20, thereby decreasing the effective flow rate of service liquid through the second stage. The decreased flow rate through the second stage 40 reduces the compression across the second stage. Opening the bypass line 80 reduces the efficiency of the second stage 40 so that gas passing through the stage is not significantly compressed. In accordance with the present understanding of the invention, it is believed the radial dimension of the liquid ring is at least partially reduced so that the radial dimension of the liquid ring is less than R. That is, the radial dimension of the liquid ring in the second stage 40 is such that the inner surface of the liquid ting does not contact the bottom of the cell C when the cell is nearest the casing 12. As there is a gap between the liquid ring and the bottom of the cell, gas entering the second stage 40 is not significantly compressed. The lack of compression allows a greater flow rate of gas to pass through the second stage 40, thereby increasing the capacity of the second stage to pass a volume of gas through the stage. In addition, under the present understanding of the process, opening the bypass line 80 permits the higher pressure service liquid of the second stage 40 to flow through the bypass line to the lower pressure service liquid in the first stage 30.

By withdrawing service liquid from the second stage 40 during the evacuation cycle so that the flow rate through the second stage is less than the flow rate through the first stage 30, the first stage is allowed to do substantially all the work in the compression range of the liquid ring vacuum pump 10 where the second stage is not required. The increase in service liquid in the first stage 30 maximizes the first stage gas compression so that the first stage presents the second stage 40 with a quantity of compressed gas that the second stage can accommodate at a rate substantially equal to the rate the gas is compressed by the first stage. The quantity of service liquid taken from the second stage 40 supplements the base flow rate of service liquid through the first stage 30. Therefore, the relative integrity and effectiveness of the liquid ting in the second stage 40 is reduced which allows for reduced compression across this stage and increases the capacity of the second stage to receive compressed gas from the first stage 30.

In a preferred embodiment, the control valve 90 is operably connected to the control signal device 92 such as a pressure sensor in fluid communication with the vessel. Upon a predetermined vacuum (or pressure) in the vessel, the control signal device 92 sends a control signal to the control valve 90 to close the control valve and prevent flow of the service liquid 50 through the bypass line 80 from the second stage 40 directly to the first stage 30.

Generally, when the overall compression ratio of the pump 10 is greater than 10:1, the bypass line 80 may be closed and the pump operates in its normal mode, wherein the overall amount of compression is balanced between the two stages 30, 40 and the flow rate of service liquid through the first and second stages is substantially equal. However, the specific overall compression ratio at which flow through the bypass line 80 may be regulated is a matter of design and performance characteristics choice. The amount of service liquid required in this pressure range can be the determinant for sizing the service liquid supply system.

Although the control valve 90 and flow through the bypass line 80 have been described in terms of a fully closed or fully open flow, the control valve and control signal device 92 can be used to regulate flow through the bypass line at any desired percentage of full flow. That is, the flow from the second stage 40 to the first stage 30 through the bypass line 80 can be infinitely varied in response to or anticipation of certain parameters or loads on the pump.

Alternatively, the bypass line 80 may remain open during normal or continuous operation. When the bypass line 80 remains open, the portion of the service liquid passing through the bypass line does not pass through the recirculation unit 70. Therefore, the service liquid from the bypass line 80 has a slightly higher temperature than the service liquid from the recirculation unit 70. Combination of the bypass service liquid and the recirculation service liquid raises the temperature of the service liquid in the first stage 30. Therefore, the maximum achievable capacity at low suction pressures will be a function of the vapor pressure of the warmer service liquid. That is, at the holding point or steady state operation, the load on the first stage will include the flashing service liquid and the gas from the vessel being evacuated.

Service liquid flow through the bypass line 80 improves overall pump capacity without the need for increased sizing of the recirculation unit 70, or external service liquid supply, thus allowing for matching the pump components to the average service liquid requirements without sacrificing the capability of the pump 10.

While a preferred embodiment of the invention has been shown and described with particularity, it will be appreciated that various change and modifications may suggest themselves to one having ordinary skill in the art upon being apprised of the present invention. It is intended to encompass all such changes and modifications as fall within the scope and spirit of the appended claims.

What is claimed:

1. A two stage liquid ring vacuum pump having a suction port and a discharge port, and a first stage and a second stage intermediate of the suction port and the discharge port, the first stage defining a first pumping volume and the second stage defining a second smaller pumping volume, wherein upon operation of the pump a given flow rate of service liquid passes through the first stage to the second stage to exit the pump through the discharge port, comprising:

(a) a bypass line fluidly connected to the second stage intermediate the first stage and the discharge port, and to the first stage for permitting fluid flow from the second stage to the first stage so that the flow rate of service liquid through the first stage is greater than the flow rate of service liquid passing through the discharge port.

2. A two stage liquid ring vacuum pump for evacuating a vessel, the liquid ring vacuum pump having a suction port and a discharge port, and a first stage and a second stage intermediate of the suction port and the discharge port, the first stage defining a first pumping volume and the second stage defining a second smaller pumping volume, comprising:

(a) a fluid bypass line fluidly connected to the first stage and the second stage, the connection to the second stage being intermediate of the first stage and the discharge port;

(b) a control valve operably connected to the bypass line for selectively regulating a service liquid flow through the bypass line from the second stage to the first stage during operation of the pump; and (c) a control signal generator for selectively actuating the control valve to regulate the service liquid flow through the bypass line from the second stage to the first stage during operation of the pump.

3. The two stage liquid ring vacuum pump of claim 2, wherein the fluid bypass line is fluidly connected to a service liquid recirculation line for introduction into the first stage.

4. The two stage liquid ring vacuum pump of claim 2, wherein the fluid bypass line is fluidly connected to the first stage at an inlet port in the first stage.

5. A two stage liquid ring vacuum pump having a first stage and a second stage intermediate of a suction port and a discharge port, the first stage having a first pumping volume and the second stage having a second smaller pumping volume, wherein a service liquid flows from the first stage to the second stage and is exhausted through the discharge port, comprising:

(a) a bypass port in the second stage intermediate of the first stage and the discharge port for venting a portion of the service liquid from the second stage; and (b) a bypass line fluidly connected to the bypass port and the first stage for introducing at least a portion of the vented service liquid into the first stage.

6. The liquid ring vacuum pump of claim 5, wherein the bypass port intersects the second stage at the point of highest pressure in the second stage liquid ring.

7. The liquid ring vacuum pump of claim 5, wherein the bypass port radially intersects the second stage.

8. The liquid ring vacuum pump of claim 5, wherein the bypass port tangentially intersects the second stage.

9. The liquid ring vacuum pump of claim 5, further comprising a plurality of bypass ports and a bypass manifold fluidly connected to the plurality of bypass ports.

10. A method of compressing a gas in a two stage liquid ring vacuum pump having a first stage defining a first pumping volume and a second stage defining a second smaller pumping volume, the first stage and the second stage intermediate of a suction port and a discharge port, and to the first stage for permitting fluid flow from the second stage to the first stage so that the flow rate of service liquid through the first stage is greater than the flow rate of service liquid passing through the discharge port.

11. A method of pumping a gas through a two stage liquid ring vacuum pump, having a suction port and a discharge port, with a first stage and a second stage intermediate of the suction port and the discharge port, the first stage defining a first pumping volume and the second stage defining a second smaller pumping volume, comprising:

(a) removing service liquid from the second stage prior to the discharge port; and (b) introducing at least a portion of the withdrawn service liquid into the first stage of the liquid ring vacuum pump.

12. The method of claim 11, further comprising removing the service liquid from the second stage at a point of highest pressure of the service liquid in the second stage.

13. The method of claim 11, further comprising removing service liquid from the second stage when a pressure at the suction port is greater than a predetermined pressure.

* * * * *

UNITED STATES PATENT AND TRADEMARK OFFICE

CERTIFICATE OF CORRECTION

PATENT NO. : 5,366,348
DATED : November 22, 1994
INVENTOR(S) : Kevin J. Skelton

It is certified that error appears in the above-indentified patent and that said Letters Patent is hereby corrected as shown below:

In Claim 10, Column 10, line 17, of the patent beginning with ", and to the first stage for permitting fluid flow from the second stage to the first stage so that the flow rate of service liquid through the first stage is greater than the flow rate of service liquid passing through the discharge port" should be deleted and the following substituted --for forming a service liquid ring in the first and the second stage, comprising:

(a) withdrawing a portion of the service liquid from the second stage intermediate of the first stage and the discharge port so that a flow rate of service liquid exiting through the discharge port is less than a flow rate of service liquid entering the second stage; and (b) introducing at least a portion of the withdrawn service liquid into the first stage.--

Signed and Sealed this

Sixteenth Day of May, 1995

Bruce Lehman

*Attest:*

BRUCE LEHMAN

*Attesting Officer*

*Commissioner of Patents and Trademarks*